US008361286B1

(12) United States Patent
Giorgini

(10) Patent No.: US 8,361,286 B1
(45) Date of Patent: Jan. 29, 2013

(54) GALVANIC ANODE FOR REINFORCED CONCRETE APPLICATIONS

(76) Inventor: Roberto Giorgini, Waddinxveen (NL)

( * ) Notice: Subject to any disclaimer, the term of this patent is extended or adjusted under 35 U.S.C. 154(b) by 93 days.

(21) Appl. No.: 13/068,028

(22) Filed: May 2, 2011

Related U.S. Application Data

(63) Continuation-in-part of application No. 12/460,883, filed on Jul. 27, 2009, now Pat. No. 7,998,321.

(51) Int. Cl.
*C23F 13/16* (2006.01)

(52) U.S. Cl. ..... 204/196.37; 204/196.1; 204/196.17; 204/196.18; 204/196.19; 204/196.34; 205/734

(58) Field of Classification Search ..... 204/196.1, 204/196.17, 196.18, 196.19, 196.34, 196.347; 205/734
See application file for complete search history.

(56) References Cited

U.S. PATENT DOCUMENTS 4,435,263 A 3/1984 Lau
5,292,411 A 3/1994 Bartholomew et al.
6,022,469 A 2/2000 Page
6,033,553 A 3/2000 Bennett
6,165,346 A 12/2000 Whitmore
6,398,945 B1 * 6/2002 Henriksen ..... 205/734
6,562,229 B1 5/2003 Burgher et al.
6,572,760 B2 6/2003 Whitmore
6,896,791 B1 * 5/2005 Henriksen ..... 205/734
7,160,433 B2 1/2007 Bennett
7,488,410 B2 2/2009 Bennett et al.
7,998,321 B1 * 8/2011 Giorgini ..... 204/196.34

* cited by examiner

*Primary Examiner* — Bruce Bell
(74) *Attorney, Agent, or Firm* — Harpman & Harpman

(57) ABSTRACT

An improved sacrificial galvanic anode assembly for cathodic protection of a steel reinforced concrete structure. A galvanic cathodic protection device uses an embedded sacrificial anode of metallic foam for increased reactive surface area covered with a flexible penetrating coating to provide a continuous electrolyte to keep it active. The formulated coating paste is inert to cement embedment material and is pre-applied on the anode body prior to encapsulation. An integrated conductive contact band extends from the coated anode to attachment to a reinforcement bar for establishing electrical conductively therewith within the concrete structure transferring galvanic corrosion to the anode.

10 Claims, 4 Drawing Sheets

GALVANIC ANODE FOR REINFORCED CONCRETE APPLICATIONS

This is a continuation in part patent application of Ser. No. 12/460,883, filed Jul. 27, 2009 now U.S. Pat. No. 7,998,321.

BACKGROUND OF THE INVENTION

1. Technical Field

This invention relates to galvanic cathodic protection of embedded steel in concrete and the like. Specifically, to sacrificial anodes electrically linked to the steel reinforcement.

2. Description of Prior Art

Prior art devices of this type have relied on sacrificial anodes to address the issue of steel reinforcement corrosion which can and will occur due to the inherent porous nature of the concrete in which it is embedded. Such corrosion occurs when the concrete becomes contaminated with, for example, chloride ions from structural exposure to nature and user applied salt or carbonation due to carbon dioxide penetration into the concrete and loosing therefore its protective alkalinity. Once this occurs, the reinforcement steel will corrode increasing its volume causing accelerated failures of the surrounding concrete structure. By the use of the electrically connected sacrificial anode connected to the reinforcement steel cathodic protection is achieved, reducing or eliminating the corrosion of the steel by making it the cathode of the electric chemical cell.

One of the issues encountered in such a galvanic cathodic protection assemblies using sacrificial anodes, such as zinc or aluminum, regardless of the application venue is the size proportion of the anode to the protected structure surface.

This dissimilar surface issue in inherent by the nature of the structure being protected and the viable limitation of fixed anode surface as a potential so matter. Since the anode and cathodic surface areas should be in equilibrium and if not the sacrificial anode is not able to provide enough polarization to the protected structure, although the current of the anode varies insignificantly and is referred to as "mixed potential theory" illustrated in FIGS. 5 and 6 of the drawings showing a graphic display of "potential E" and anode and cathode related to increase cathode area.

FIG. 5 is a graphic depicting basis when dissimilar metals are connected electrically in a solution, they are forced to adapt the same potential and not their "at rest" potential. This example illustrates iron Fe and zinc Zn connected in an electrolyte with iron being the cathode and zinc the anode with the corrosion potential given at the illustration of the anode and cathode reactions.

FIG. 6, however, illustrates the effect of changing the area of one electrode relation to the other with total current, not current density on the YX axis, as shown. This illustrates the increased cathode area in the corresponding intersection of the zinc to the iron as surface area increases.

It will be evident therefore that criticality of effectively increasing the surface of the anode is relevant to the efficiency and practicality in any galvanic cathodic protection system.

Galvanic cathodic protection using sacrificial anodes such as zinc and aluminum which have inherently negative electro chemical potentials establishes a passive protective current flow which is well known and understood in the art, see for example U.S. Pat. Nos. 4,435,263, 5,292,411, 6,022,469, 6,033,553, 6,165,346, 6,562,229, 6,572,760, 7,160,433 and 7,488,410.

In U.S. Pat. No. 4,435,263, a back fill composition for magnesium galvanic anodes is disclosed using calcium sulphite, bentonite and one compound from a group of sodium alkylates and sodium dialkyldithiocarbamates.

U.S. Pat. No. 5,292,411 is directed to a method of patching eroded concrete using a metal anode with an ionically conductive hydrogel attached to a portion of the anode being in elongated folded form.

U.S. Pat. No. 6,022,469 discloses a method by which a zinc or zinc alloyed anode is set in mortar that maintains a high PH to provide passivity of the zinc anode maintaining same in an electro chemical active state.

U.S. Pat. No. 6,033,533 discloses the most effective humectants, debquescent or hydroscopic chemicals, lithium, nitrate and lithium bromine respectively to maintain a galvanic sprayed anode in active state.

U.S. Pat. No. 6,165,346 also claims a use of deliquescent chemicals to enhance the performance of the galvanic anodes.

U.S. Pat. No. 6,562,229 is drawn to a louvered metal anode with an electrocatalytically active coating on a substrate.

U.S. Pat. No. 6,572,760 illustrated the use of deliquescent material bound into a porous anode body to maintain the anodes electro chemical active properties.

U.S. Pat. No. 7,160,433 claims a cathodic protection system in which zinc anode embedded in mortar in which a humectant is employed to impart high ionic conductivity.

Finally, U.S. Pat. No. 7,488,410 shows an anode assembly for cathodic protection using an anode covered with an ionically conductive material having an electro chemical activating agent configured to conform closely to the steel reinforcing bar in which it adjacently protects.

SUMMARY OF THE INVENTION

A galvanic cathodic protection system using a zinc anode electrically connected to an embedded reinforcing steel within a concrete structure. The anode is precoated with a unique flexible lightly acidic paste formulation to maintain continuous reaction keeping the anode active. The paste coating is an auto moistening electrolyte configuration maintaining the zinc as zinc-ions ($Zn^2$) in the acidic environment.

DETAILED DESCRIPTION OF THE INVENTION

Figure 1:
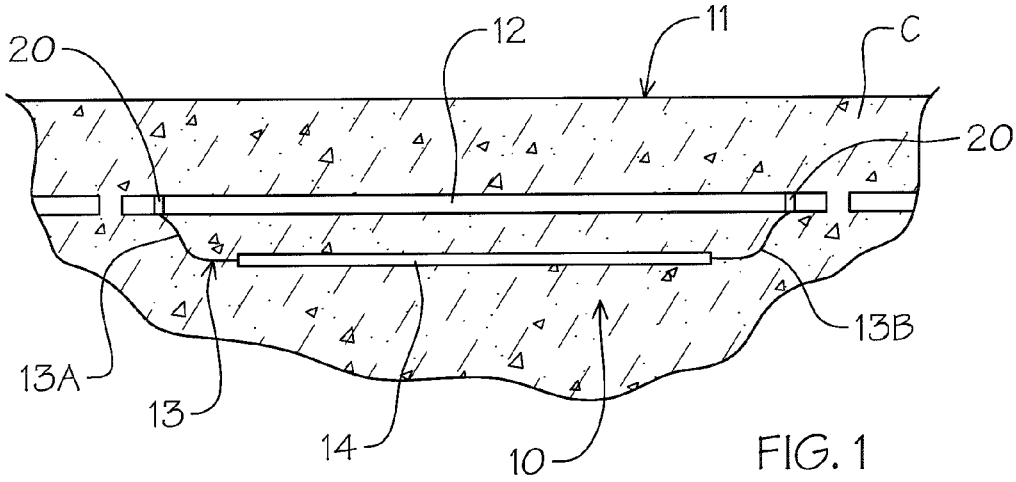
FIG. 1 is a graphic side elevational view partially in cross-section of the present invention in use.
Figure 2:
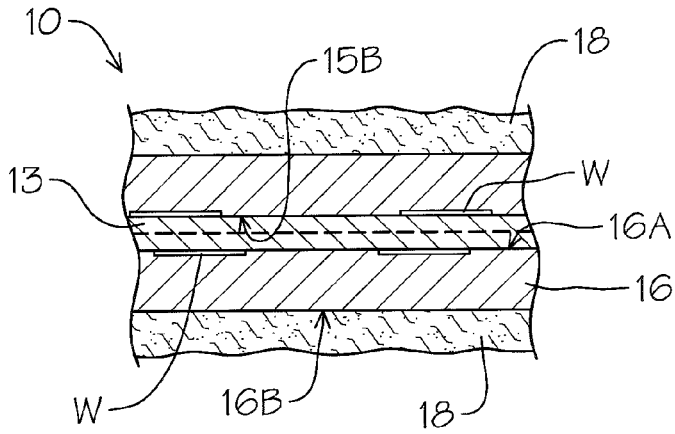
FIG. 2 is an enlarged partial sectional view of the assembled anode.
Figure 3:
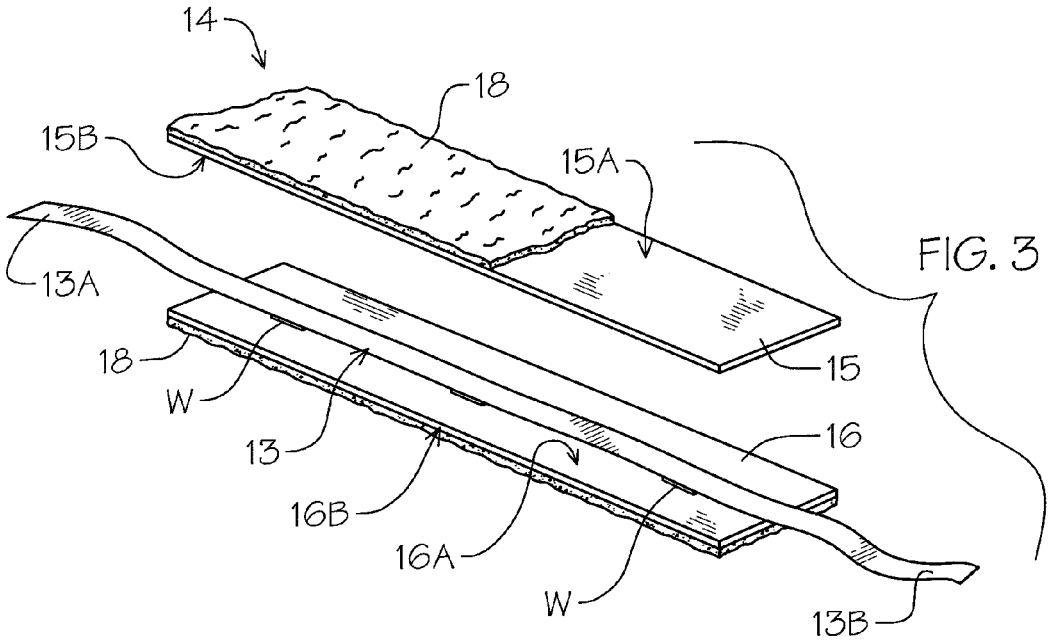
FIG. 3 is an exploded isometric view of the anode assembly of the invention.

Referring to FIG. 1 of the drawings, an anode assembly 10 of the invention can be seen, in use, embedded within a concrete structure 11 having a steel reinforcing bar 12 therewithin. The anode assembly 10 is in this example positioned adjacent the reinforcing bar 12 with an electrical interconnection band 13 extending in oppositely disposed relation outwardly therefrom. The electrical connection band 13 extending portions 13A and 13B are secured to the surface S of the reinforcement bar 12 in longitudinally spaced relation defining an electrical link with the steel reinforcement bar 12 and an electrically charged transfer flow current circuit. An anode 14 is of a multiple layer configuration, best seen in FIGS. 2 and 3 of the drawings having zinc sheets 15 and 16 each having an upper and lower contact surface 15A, 15B, 16A and 16B respectively. The zinc sheets 15 and 16 are secured together by spot welding W by their respective contact surfaces 15A and lower contact surface 16B with the electrically conductive band 13 secured first to the contact surface 15A by spot welding between the sheets 15 and 16 which are then secured together surrounding the conductive band 13 by the hereinbefore described spot welding W defining a pre-assembled anode configuration at 14.

Figure 7:
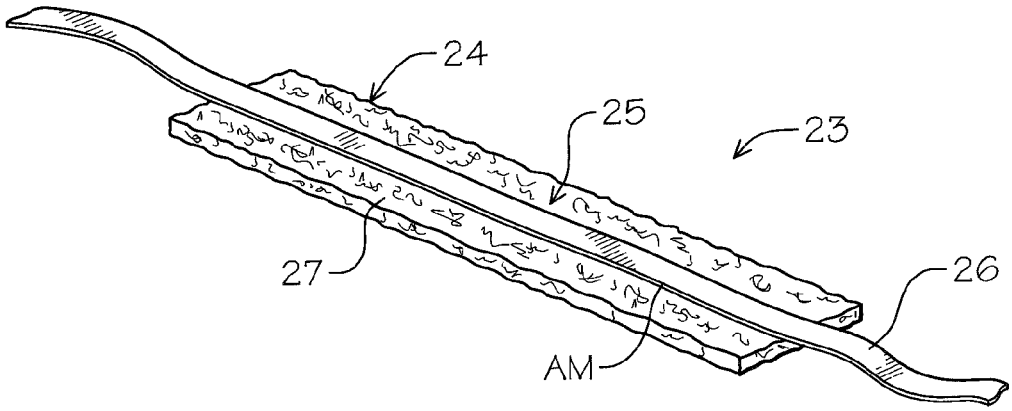
FIG. 7 is an exploded isometric view of an alternate anode assembly with increased surface anode material achieved by metallic foam construction.

Referring now to FIG. 7 of the drawings, an example of an alternate anode construction assembly 23 can be seen to address an inherent problem directed towards anode and cathode surface area equilibrium. It has been an established solution that by simply increasing the anode surface area by use of a larger anode is simply not a practical solution given the venue embodiments required.

The alternate anode assembly 23 addresses the shortcoming by effectively increasing the anode's reactive surface by the use of a metallic foam material 24. Such metallic foam materials 24 are referred to as a class of materials that are characterized by a structural nature that is not completely monolithic and having a somewhat random structure of increased surface area within the same dimensional parameters. Such metallic foam materials 24 can be taken from a group defining, but not limited to the following, "cellular metal" divided into distinct cells with interconnecting voids, "porous metal" containing multiple pores and curved gas voids with smooth surfaces, "metallic foam" in which a solid foam is derived from a liquid foam and also a synthetic plastic foam with corresponding open pore structures, all well known.

Additionally, the group may include "metal sponge" wherein space is filled by pieces of metal that form a continuous network which co-exist with a network of empty space which is also inter-reactive and such mesh configuration that would so enable same.

It will be evident to one skilled in the art that such characterized "metallic foam" materials 24 including "mesh" configurations have increased surface dimensionality over a solid prescribed anode, such as zinc sheet 15 which is limited to its surface dimension illustrated hereinbefore.

Figure 8:
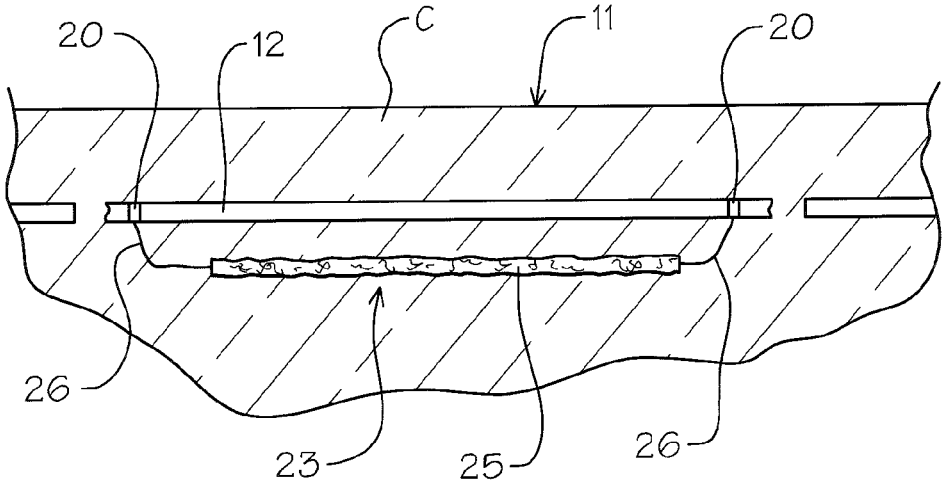
FIG. 8 is a graphic side elevational view partially in cross section of the alternate form of the invention in use.

By the use of such metallic foam materials 24 in an alternate anode construction assembly 23 in which metallic foam sheets 25 with an electrically conductive band 26 secured to by known attachment methods AM. The metallic foam sheets 25 are coated with a modified electrolyte paste 27 which is capable of a surface coating penetration so that all such foam induced voids are filled. This defines a stronger polarization with a total anode surface polarization efficiently increasing therefore the relative surface area of the anode assembly 23 to achieve and improve "equilibrium" of such dissimilar metals in a cathodic surface area induced reaction thereby affording greater and longer lasting protection of the protected material such as steel enforcing bars 23 illustrated in an alternate construction hereinbefore described and as seen in FIG. 8 of the drawings.

The final assembly step of the preferred pre-assembled anode 17 hereinbefore described which is a key and critical aspect of the invention is an auto-moistening electrolyte paste coating 18 of the invention which is applied to the opposing exposed zinc surfaces 15B and 16A after the anode 14 is pre-assembled as hereinbefore described. The electrolyte paste coating 18 is of a flexible compound requiring no additional humectants or deliquescent to be added to keep the zinc active as is required in traditional galvanic protection process. The electrolyte paste coating 18 provides a number of important properties to assure adherence and flexibility between the anode 14 and surrounding concrete C in which it is embedded. The electrolyte paste 18 is comprised of by weight an ion conductive water based acrylic binder in the range of 10-400 parts, preferably 100 parts for a total of 25% by weight.

A hydrochloric acid in 10% solution in a range of 5-60 parts preferably 60 parts or 15% by weight.

An inert filler material, in this example, mica in the range of 50-400 parts or 50% by weight.

An alcohol based water binder, in this example, polyol in the range of 0-100 parts preferably 40 parts or 10% by weight.

It will be evident that components of the electrolyte paste 18 such as the acrylic binder and inert filler mica can be one selected from a corresponding family of like materials having similar properties and can be easily substituted within the perview of one skilled within the art and such composition as defined by this example are therefore not limited thereto.

Given this composition, the electrolyte paste coating 18 is thus lightly acidic with a PH in the range of 4.5 to 6 therefore not neutralized by the alkaline cement and provides higher current densities and is more durable than the prior art alkaline coatings having a typical PH of 12 or above which was previously thought to be required and helped to maintain the zinc in an active state.

Such acidic environment maintained by the paste 18, the coated zinc anode remains active and remains as a zinc-ion $Zn^2$. Thus when even small amounts of chlorides are present, a preferential reaction will occur between the zinc and the chloride into $ZnCL^2$. Zinc chlorides are found to be highly soluble and hygroscopic and therefore will not form any insoluble passive layer on the zinc thus effectively auto moistening, assuring that no additional humectants or deliquescent as needed to keep the zinc active. The electrolyte paste 18 formulation used with the anode assembly 17 of the invention will be of superior performance binding sufficient water for proper conductivity with no chemical interaction between the paste 18 and concrete alkaline pore water solution.

Figure 4:
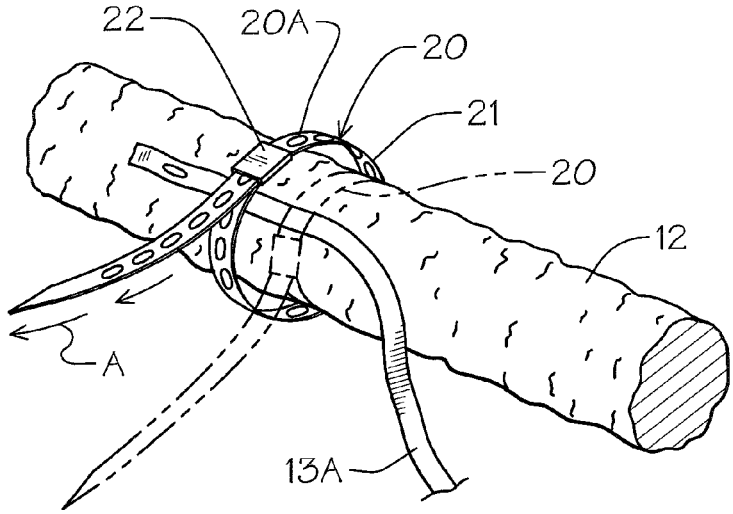
FIG. 4 is an enlarged perspective partial view of an electrically conductive tie for securing the anode conductors to the reinforcing bar.
Figure 5:
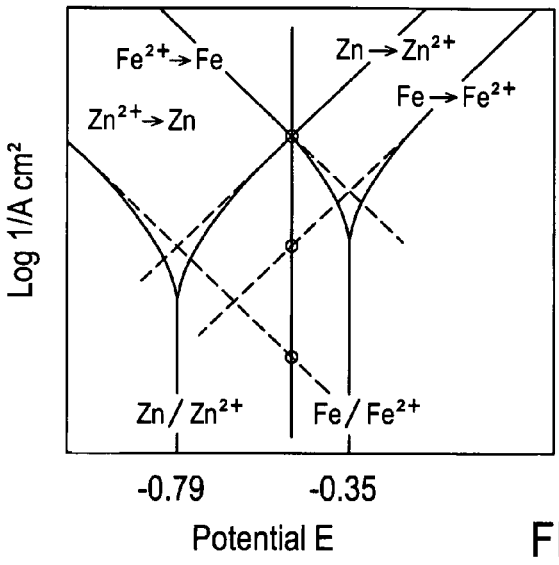
FIG. 5 is a "Potential E" graph showing the baseline of intersection of cathode to anode connected electrically in a solution.
Figure 6:
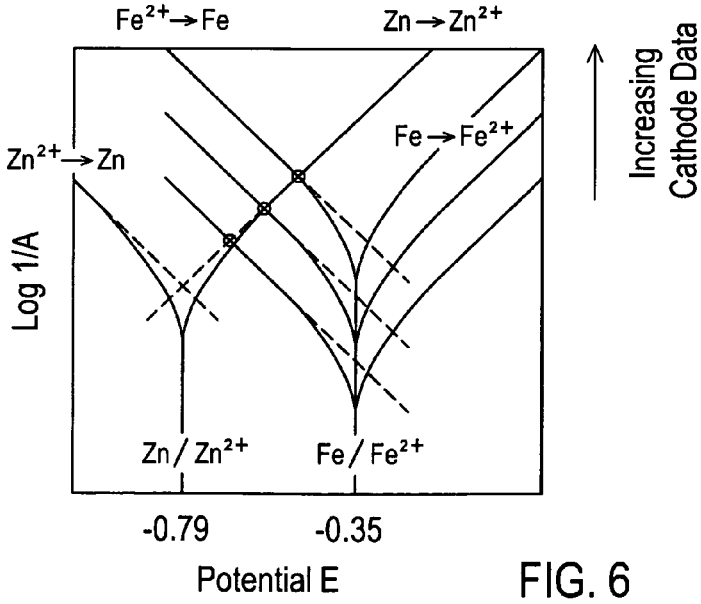
FIG. 6 is a graphic illustration showing "Potential E" of cathode to anode in increasing cathode area points of intersection.

Referring now to FIGS. 1 and 4 of the drawings, an anode attachment tie 20 can be seen for securing the anode electrical interconnection bands 13 to the reinforcing bar 12 before embedding into the concrete C of the so defined structure 11 as hereinbefore described. The anode attachment tie 20 preferably formed from a flexible steel band body 21 having an adjustable lock to length pass through one-way ratchet fastener fitting 22 on one end thereof. The band body 21 defines a ladder tie configuration with engageable surface openings at 20A therein which allows for adjustable registration within the fastener fitting 22, locking the effective tie band engagement length about the reinforcement bar 12 mechanically and electrically joining the interconnecting bands 13A and 13B thereto illustrated by adjustment arrows A in broken lines in FIG. 4 of the drawings and fasteners F in solid lines in FIG. 1 of the drawings.

It will thus be seen that a new and novel galvanic cathodic protection system utilizing a zinc anode assembly coated with a unique auto moistening electrolyte paste having an effective low PH range has been illustrated and described and it will be apparent to those skilled in the art that various changes and modifications may be made therein without departing from the spirit of the invention.

Therefore I claim:

1. A galvanic cathodic protection system for reinforced concrete structures comprising, a sacrificial anode construction embedded within said concrete structure in close proximity to a reinforcing bar therewithin, said anode construction is of a metallic foam media, an elongated electrically conductive member interconnected to said anode in electrical communication with said reinforcing bar for protective current flow, an electrolyte paste coating said exposed surface and infilling surrounding voids of said anode metallic foam, said electrolyte paste having acidic properties of a PH of 4.5-6 therefore non-reactive to alkaline cement.

2. The galvanic cathodic protection system set forth in claim 1 wherein said metallic foam media anode is from a group comprising cellular metal, porous metal, metallic foam and metal sponge and mesh configurations.

3. The galvanic cathodic protection system set forth in claim 1 wherein said metallic foam media anodes and said electrically conductive member are secured together.

4. The galvanic cathodic protection system set forth in claim 1 wherein said acidic electrolyte coating is a modified electrolyte paste containing 25% by weight ion conductive water based acrylic, 15% by weight hydrochloric acid in a 10% solution, 50% by weight of inner filler material mica and 10% by weight alcohol based water binder polyol.

5. The galvanic cathodic protection system set forth in claim 1 wherein said electrolyte coating on said assembled metallic foam media anode construction is flexible, infilling and auto moistening.

6. The galvanic cathodic protection system set forth in claim 1 wherein attachment of said electrically conductive member with said reinforcing bar comprises, a ferrous metal flexible tie.

7. The ferrous metal tie set forth in claim 6 wherein said ferrous metal tie comprises a steel strap, a one-way locking fastener fitting on one end thereof for slidably receiving said free end of said strap therethrough.

8. A galvanic cathodic protection device for steel reinforced concrete structures comprises, a sacrificial anode metallic foam media assembly in electrical communication with a reinforcing bar embedded within said concrete structure, an electrolyte flexible coating covering, filling and formatting on said anode foam media, said electrolyte coating having an acid property of a PH range of less than 6.

9. A galvanic cathodic protection device set forth in claim 8 wherein said anode is from a group of metallic foam media including cellular metal, porous metal, metallic foam, metal sponge and mesh configuration.

10. The galvanic cathodic protection device set forth in claim 8 wherein said electrical communication with said reinforcing bar comprises, an electrical conducted band extending from said anode in oppositely disposed direction to said reinforcing bar.

* * * * *